US007984720B2

(12) United States Patent
Tu

(10) Patent No.: US 7,984,720 B2
(45) Date of Patent: Jul. 26, 2011

(54) BOBBY PIN

(75) Inventor: Jui-Ming Tu, Tainan (TW)

(73) Assignee: Tsorng Ta Enterprise Co., Ltd., Tainan (TW)

( * ) Notice: Subject to any disclaimer, the term of this patent is extended or adjusted under 35 U.S.C. 154(b) by 595 days.

(21) Appl. No.: 11/933,873

(22) Filed: Nov. 1, 2007

(65) Prior Publication Data

US 2008/0257375 A1 Oct. 23, 2008

(51) Int. Cl.
*A45D 8/00* (2006.01)
*A45D 8/20* (2006.01)

(52) U.S. Cl. ..... 132/276; 132/277

(58) Field of Classification Search ..... 132/277, 132/276, 278–279, 275, 273; D28/39–41; 24/531

See application file for complete search history.

(56) References Cited

U.S. PATENT DOCUMENTS

| | | | | |
|---|---|---|---|---|
| 5,996,593 | A * | 12/1999 | Horman | 132/278 |
| 6,082,371 | A * | 7/2000 | Bader-Saltzman et al. | 132/276 |
| 6,257,249 | B1 * | 7/2001 | Thomas et al. | 132/273 |
| 6,408,859 | B1 * | 6/2002 | Shyu | 132/276 |
| 2003/0196675 | A1 * | 10/2003 | Chang | 132/277 |
| 2004/0182411 | A1 * | 9/2004 | Rogers et al. | 132/277 |

* cited by examiner

*Primary Examiner* — Robyn Doan
(74) *Attorney, Agent, or Firm* — J.C. Patents

(57) ABSTRACT

A bobby pin includes a left body and a right body respectively having plural ribs that are formed with plural teeth for engaging with each other to keep hair firmly clamped. The left and the right body have an opening device that is provided with a root member respectively, with a pivotal pin mounted with a compression spring and a torsion spring. In using, press inward the two bodies to keep the teeth engaged with each other for clamping hair. And, as long as the opening device is pressed, the two bodies can be immediately separated from each other for releasing hair.

11 Claims, 10 Drawing Sheets

BOBBY PIN

BACKGROUND OF THE INVENTION

1. Field of the Invention

This invention relates to a bobby pin, particularly to one having its left body and its right body provided with teeth to engage with each other to firmly clamp hair. In using, just press inward the two bodies to keep the teeth engaged with each other for clamping hair. And, press an opening device pivotally installed between the two bodies to keep the two bodies widely separated for releasing the bobby pin from hair.

2. Description of the Prior Art

As shown in FIGS. 1~3, a conventional bobby pin 1 includes a left body 11 and a right body 12. The left body 11 and the right body 12 are respectively provided with a pressing grip 110 and 120, an axial base 111 and 121 for a pivotal pin 13 to pass through, and a torsion spring 14 mounted around the pivotal pin 13. By means of the torsion spring 14, the left body 11 and the right body 12 are forced to closely clamp each other while not opening the bobby pin 1, as shown in FIGS. 2 and 3. On the contrary, if the bobby pin 1 is to be used, a user has to use two fingers to press the pressing grips 110 and 120 to make them separated for clamping hair. Likewise, the bobby pin 1 can be removed from hair by pressing the pressing grips 110 and 120 to keep the left body 11 and the right body 12 widely separated from each other. Although the conventional bobby pin 1 can basically achieve the purpose of clamping hair, but it needs substantial strength to force the left body 11 and the right body 12 widely opened by pressing with fingers.

SUMMARY OF THE INVENTION

The objective of this invention is to offer a bobby pin able to firmly clamp hair with a tri-dimensional authentic decoration.

The main characteristics of the invention are described below.

1. As long as a left body and a right body of the bobby pin are pressed to close up, the teeth of the left body and the right body are to automatically engage with each other to clamp hair.

2. A user needs only to press two sides the left body and the right body to enable the left body and the right body widely separated from each other for releasing the bobby pin from hair.

3. With an opening device having a pivotal pin inserted through two root portions respectively provided in the left body and the right body, a compression spring and a torsion spring, the left body and the right body can be easily separated widely in case of pressing it.

BRIEF DESCRIPTION OF DRAWINGS

This invention is better understood by referring to the accompanying drawings, wherein.

DETAILED DESCRIPTION OF THE PREFERRED EMBODIMENT

As shown in FIGS. 4-7, a preferred embodiment of a bobby pin in the present invention mainly includes a left body 2 and a right body 3.

Figure 8:
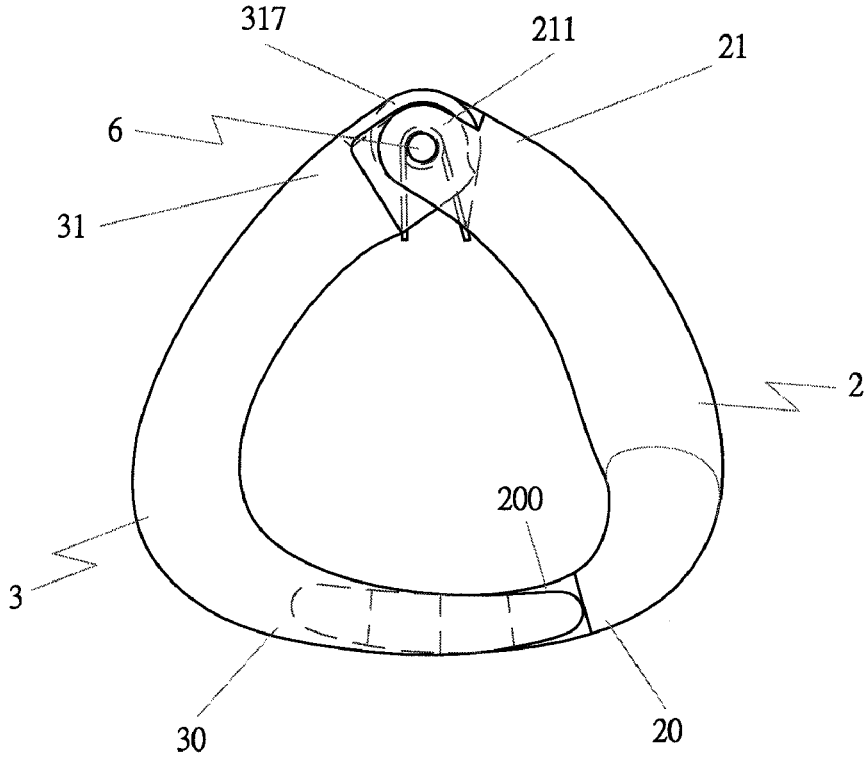
FIG. 8 is a side view of the preferred embodiment of a bobby pin in the present invention, showing it being closed up.
Figure 9:
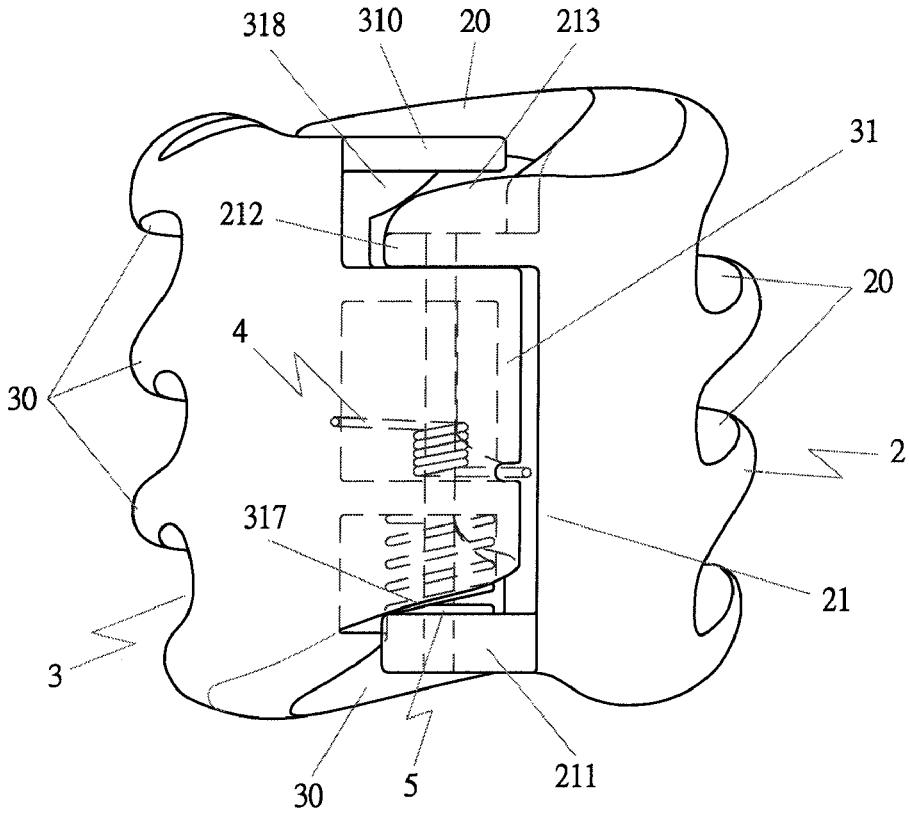
FIG. 9 is a top view of the preferred embodiment of a bobby pin in the present invention, showing it being closed up.
Figure 10:
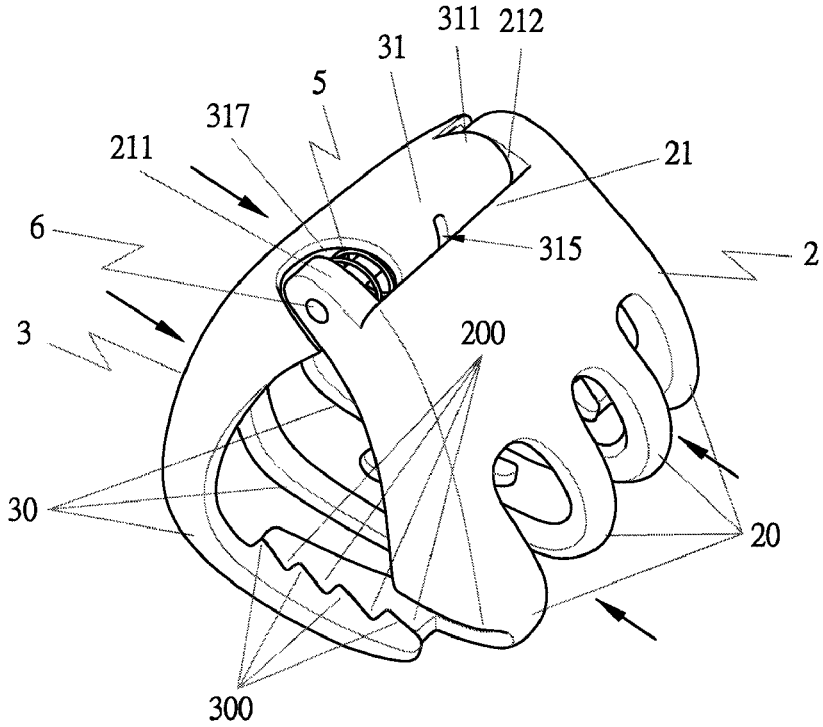
FIG. 10 is a perspective view of the preferred embodiment of a bobby pin in the present invention, showing it being closed up.
Figure 11:
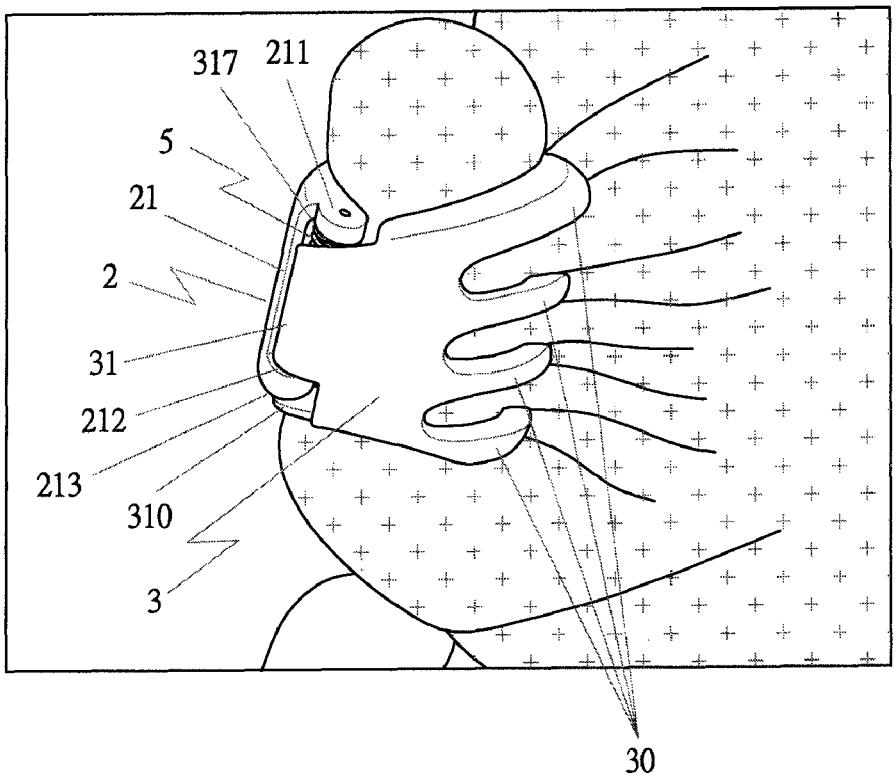
FIG. 11 is a perspective view of the preferred embodiment of a bobby pin in the present invention, showing it being fastened with hair.
Figure 12:
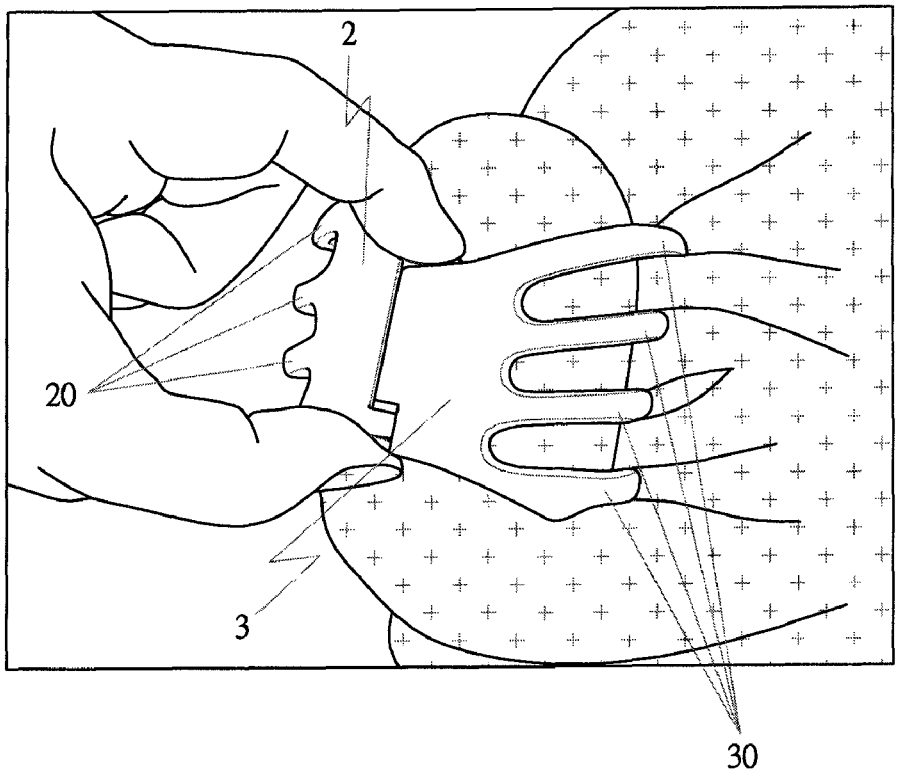
FIG. 12 is a perspective view of the preferred embodiment of a bobby pin in the present invention, showing it being pressed by fingers to loosen hair.
Figure 13:
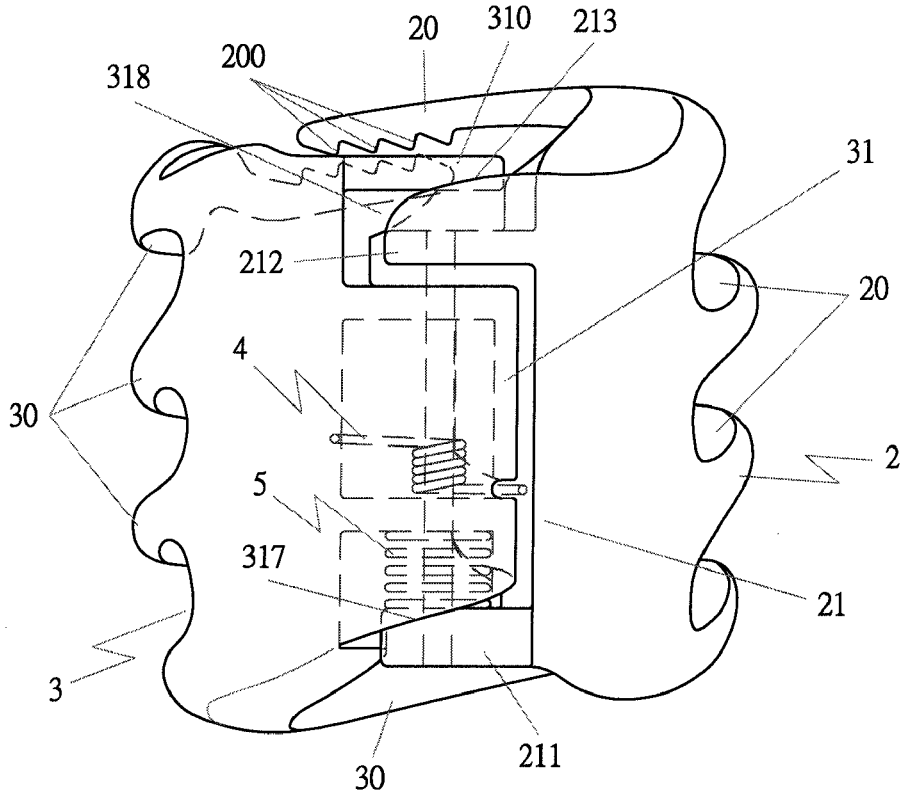
FIG. 13 is a top view of the preferred embodiment of a bobby pin in the present invention, showing it being pressed by fingers to loosen hair.

The left body 2 and the right body 3 are respectively provided with a plurality of ribs 20 and 30 alternately arrayed. The two outmost ones of the ribs 20 are respectively provided with plural teeth 200 able to engage with plural teeth 300 provided on the corresponding outmost ones of the ribs 30, so as to keep the outmost ribs 20 and the outmost ribs 30 firmly engaged with each other to properly clamp hair of varied quantity. So, in case of using the bobby pin of the invention, a user has to just close the left body 2 and the right body 3 to keep the ribs 20 and 30 arrayed alternately, and to keep the teeth 200 and 300 correspondingly engaged with each other, so that the left body 2 and the right body 3 engage with each other to firmly and properly clamp hair. It is to be noted that as the teeth 200 and 300 are plural and designed as unidirectional ones, they can be freely adjusted to alter their engaging position to properly clamp hair that can be changed in quantity accordingly, as shown in FIGS. 8 and 12.

Figure 15:
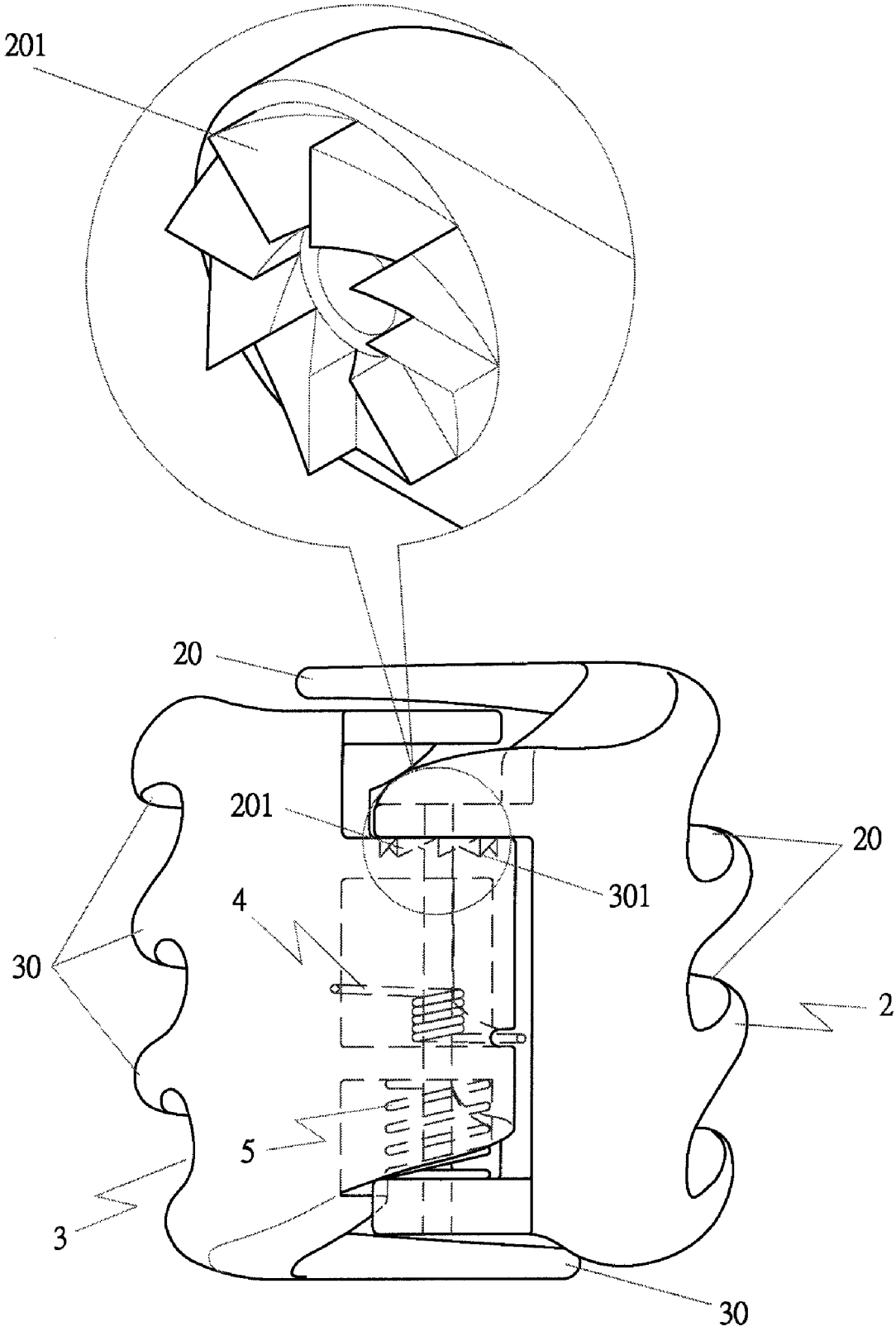
FIG. 15 is an upper view of a second preferred embodiment of a bobby pin in the present invention.
Figure 16:
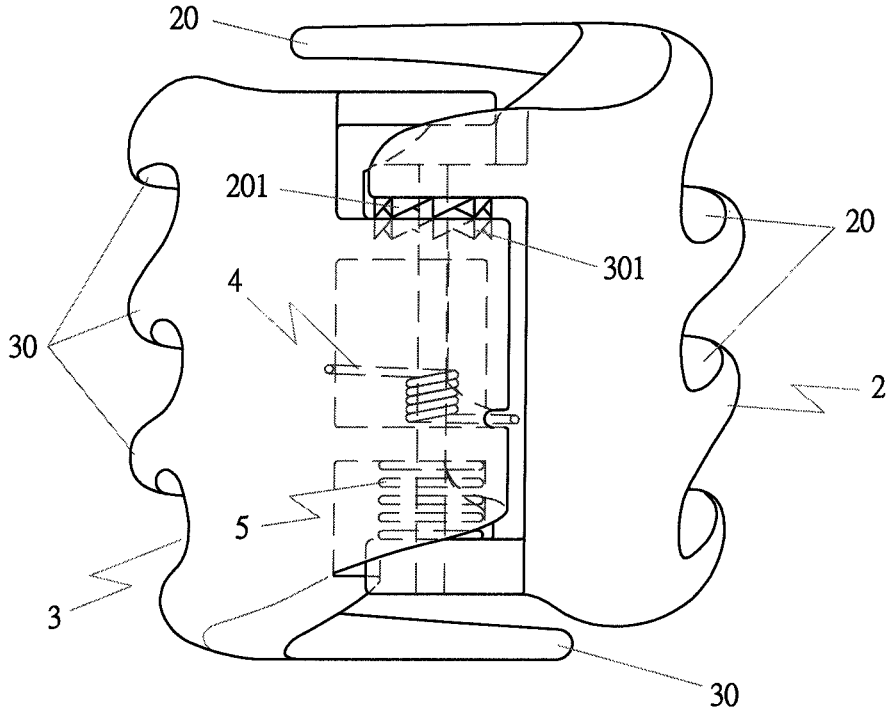
FIG. 16 is an upper view of the second preferred embodiment of a bobby pin being pressed to be released from hair in the present invention; and, FIG. 17 is a perspective view of the second preferred embodiment of a bobby pin opened widely in the present invention.
Figure 17:
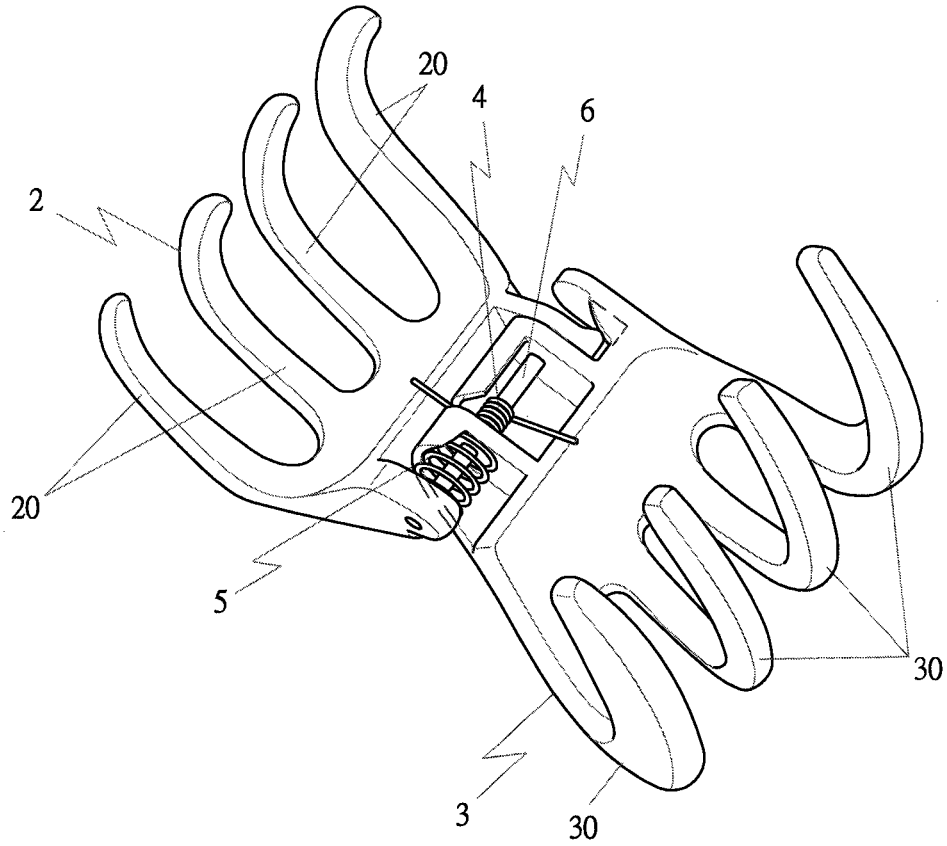

Next, a second preferred embodiment of a bobby pin shown in FIGS. 15, 16 and 17 is not provided with the ribs 20 and 30 as the first one, but with left ribs 201 and right ribs 301 formed on the left and the right body 2 and 3. Then the left and the right ribs 201 and 301 in the second preferred embodiment function just as the teeth 200 and 300 in the first one.

Figure 1:
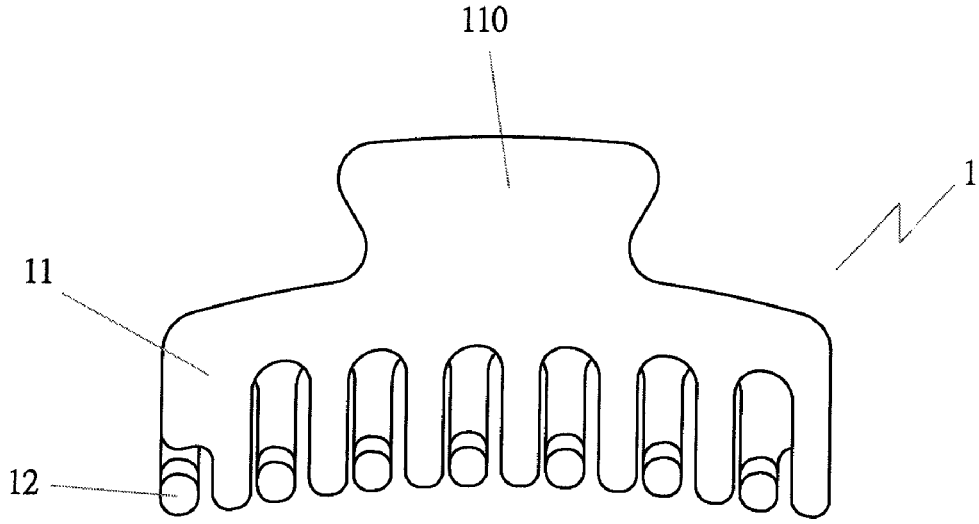
FIG 1 ( PRIOR ART )
FIG. 1 is side view of a conventional bobby pin.
Figure 2:
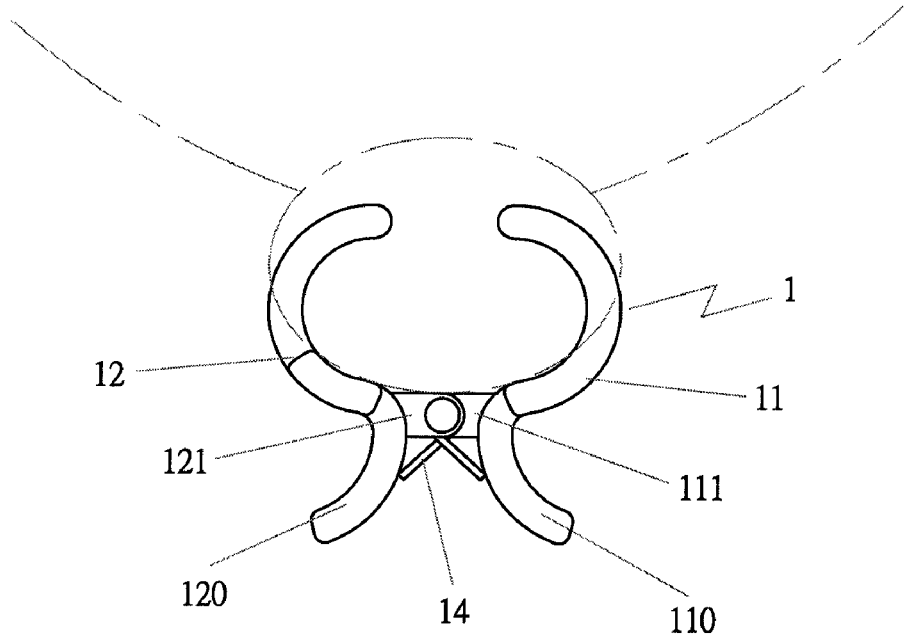
FIG 2 ( PRIOR ART )
FIG. 2 is top view of a conventional bobby pin, showing it clamping hair.
Figure 3:
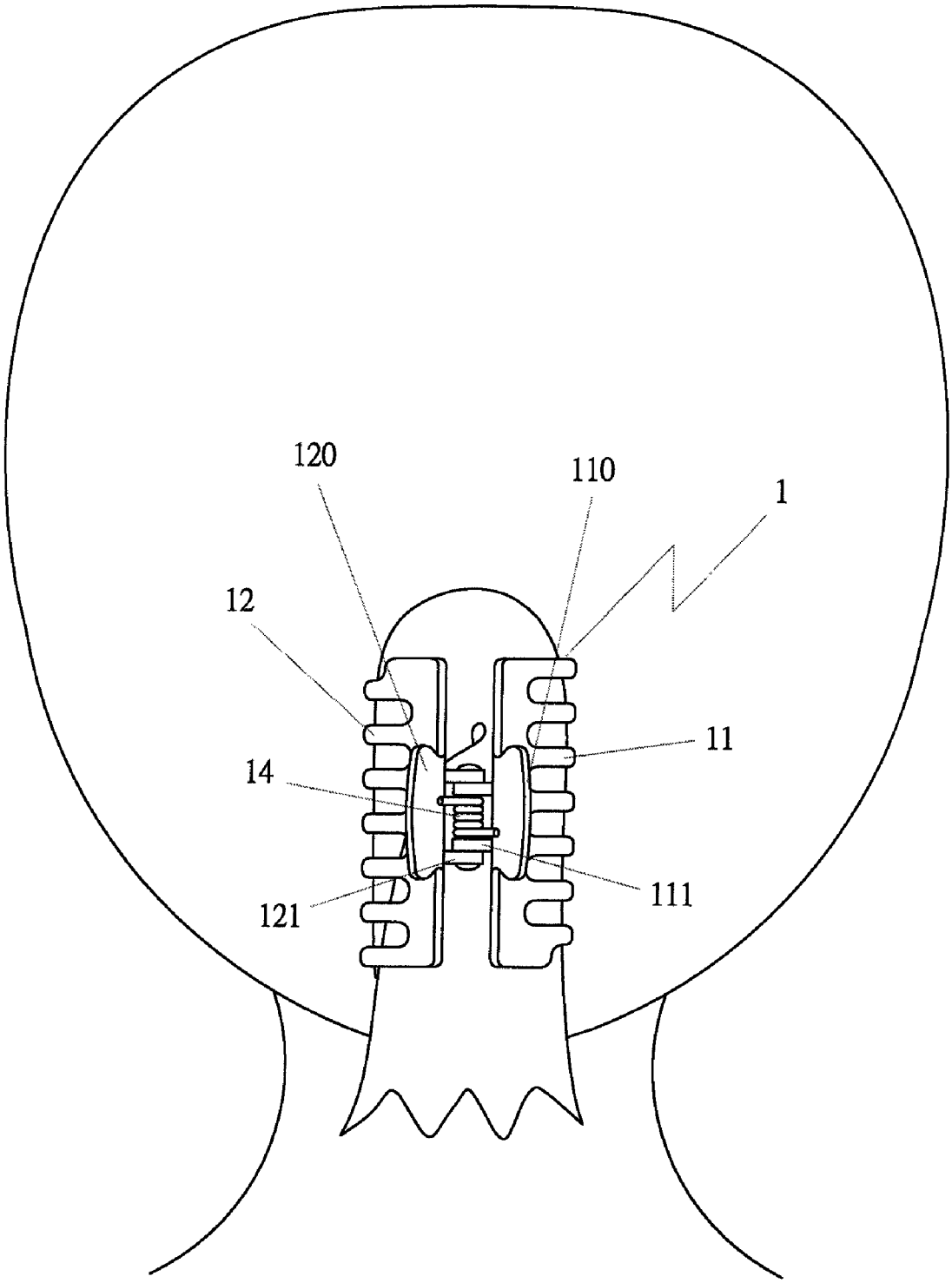
FIG 3 ( PRIOR ART )
FIG. 3 is rear view of a conventional bobby pin, showing it clamping hair.
Figure 4:
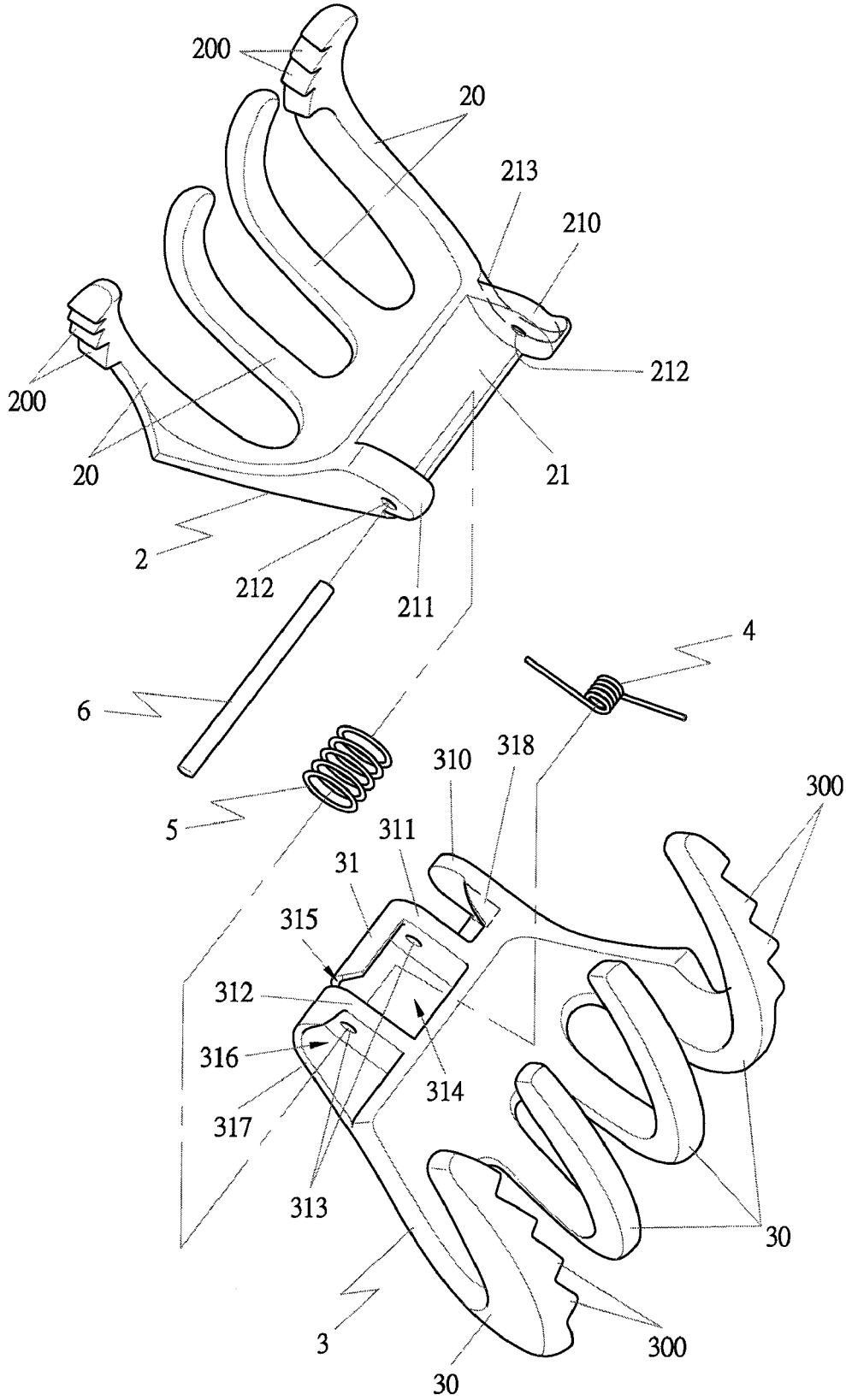
FIG. 4 is an exploded perspective view of a preferred embodiment of a bobby pin in the present invention.
Figure 5:
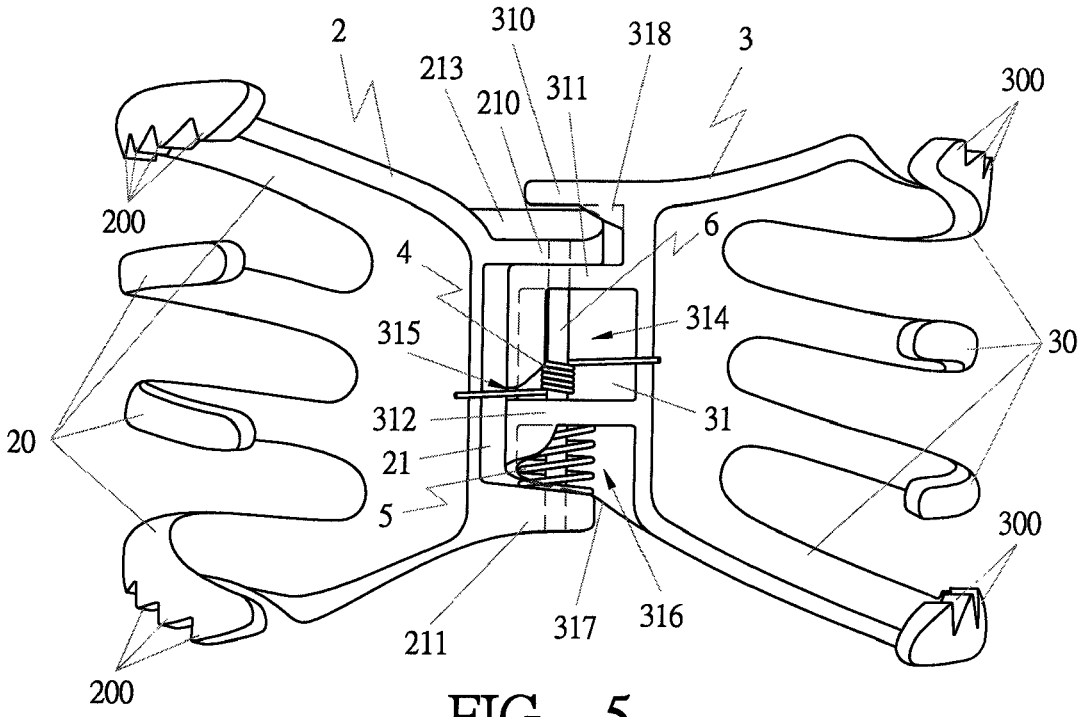
FIG. 5 is a top view of the preferred embodiment of a bobby pin in the present invention, showing it being widely opened.
Figure 6:
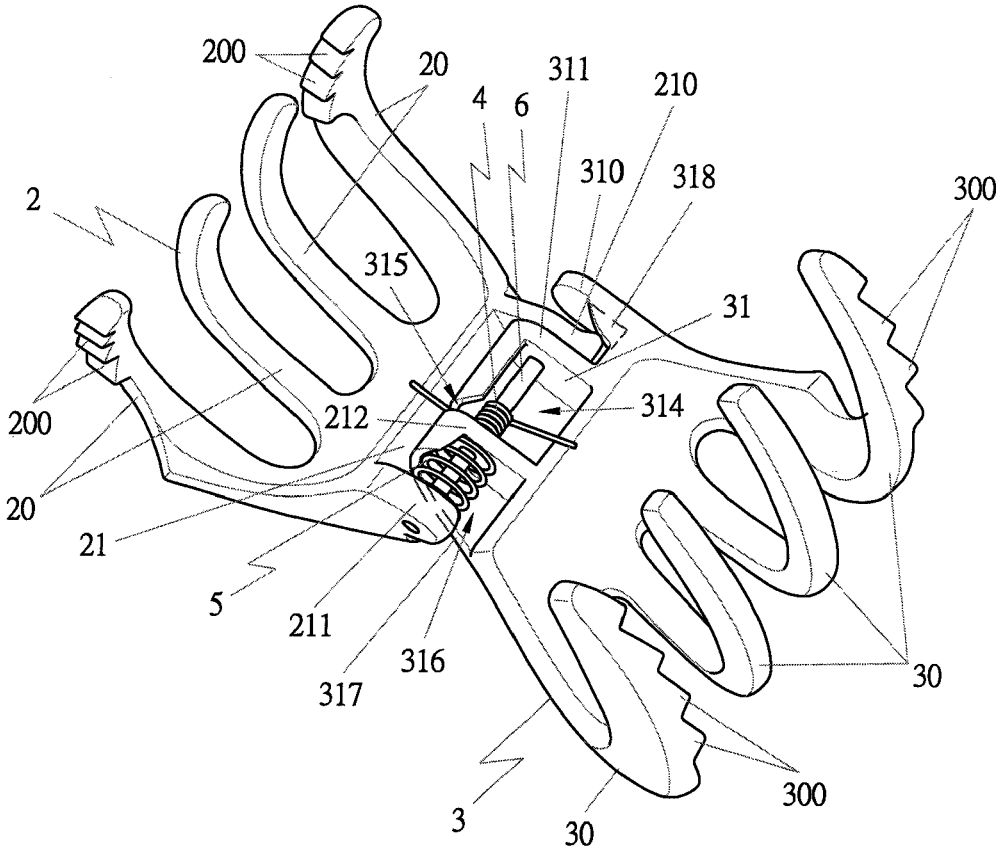
FIG. 6 is a perspective view of the preferred embodiment of a bobby pin in the present invention, showing it being widely opened.

The left body 2 and the right body 3 are respectively provided with a corresponding root member 21 and 31 installed with an opening device, which is composed of the root member 21 of the left and the right body 2 and 3, as shown in FIGS. 4-6, provided with two extending portions 210 and 211 respectively formed at its two sides and bored with a through hole 212. An arc-like rim 213 is formed on the bottom of the extending portion 210. The root member 31, as shown in FIGS. 4-6, is provided with three extending portions 310, 311 and 312. The extending portions 311 and 312 are respectively bored with a through hole 313. A contact portion 318 is formed in the extending portion 310 for restricting the scope that the left body 2 and the right body 3 can open. That is, the blocking portion 318 can block the end of the extending portion 210 of the root member 21 to limit the widest opening that the left body 2 and the right body 3 can be separated from each other. The extending portion 311 has a groove 314 cut with a notch 315 for fitting a torsion spring 4 (shown in FIGS. 5, 6, 9 and 12) to enable two ends of the torsion spring 4 to respectively lean on and push outward the left body 2 and the right body 3 (shown in FIGS. 7 and 8). The extending portion 312 is provided with a groove 316 and an outer arc-like edge 317. The groove 316 is installed with a compression spring 5 having its one end pushing the inside of the groove 316 and the other end pressed on the inside of the extending portion 210 of the root portion 21 for being ready to expand in time. And, inserted in the through hole 212 of the root portion 21 of the left body 2 and the through hole 313 of the root portion 31 of the right body 3 is a pivotal pin 6 which is also mounted with the torsion spring 4 and the compression spring 5.

Figure 7:
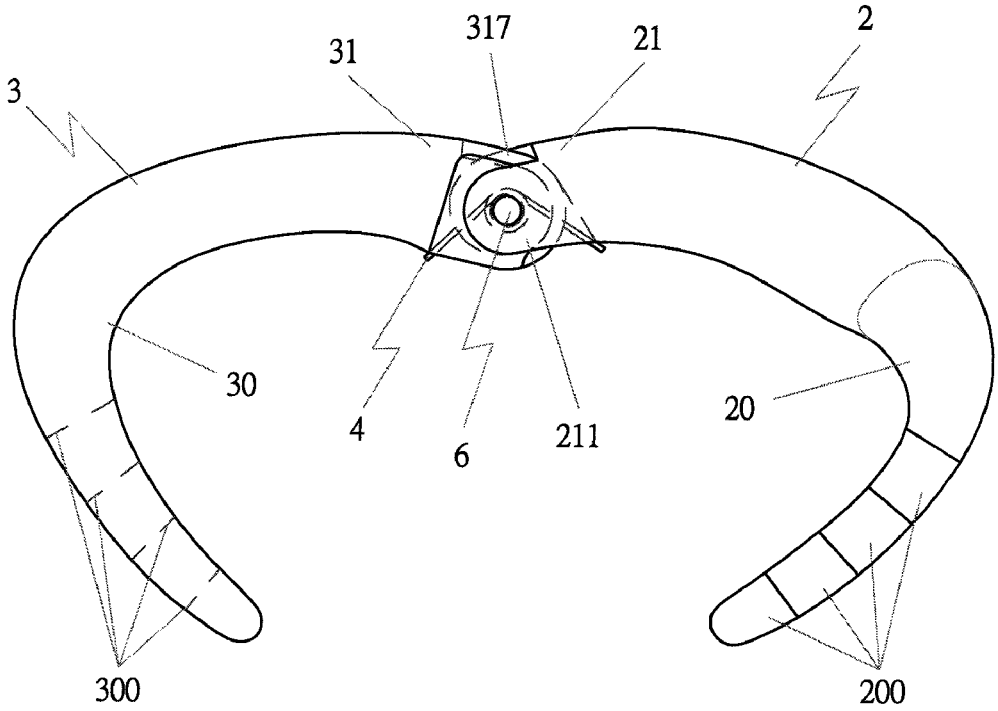
FIG. 7 is a side view of the preferred embodiment of a bobby pin in the present invention, showing it being widely opened.

As shown in FIG. 7, when the bobby pin of the invention is not used, the left body 2 and the right body 3 are forced elastically by the torsion spring 4 to open widely. By the time, as the outer arc-like edge 317 of the extending portion 312 is moved to press on the inner surface of the extending portion 211 of the root member 21, the left body 2 and the right body 3 are completely opened to be unable to be pressed, surely keeping the bobby pin opened, always ready for conveniently clamping hair.

Figure 14:
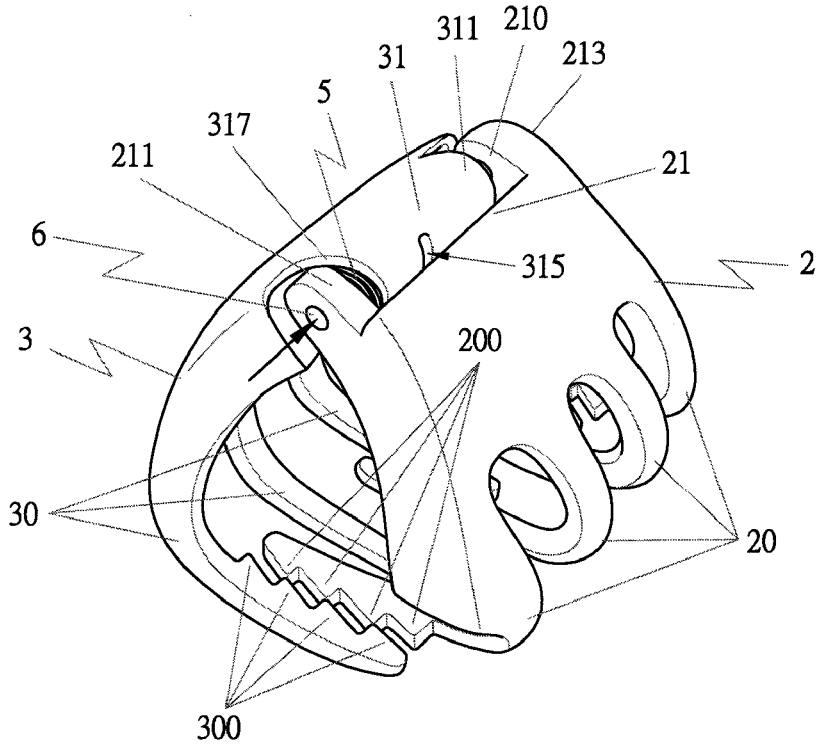
FIG. 14 is a perspective view of the preferred embodiment of a bobby pin in the present invention, showing it being released from hair.

And, when the bobby pin of the invention is to be used to clamp hair, a user needs only to press the left body 2 and the right body 3 to close to each other, keeping the teeth 200 and 300 properly pushed outward by the compression spring 5 to automatically engage with each other in accordance to the opted quantity of hair to be clamped. Moreover, as it is a unidirectional engagement between the teeth 200 and 300, the left body 2 and the right body 3 can be firmly tightened together. During the process of clamping hair with the bobby pin of the invention, as the outer arc-like edge 317 of the extending portion 312 and the extending portion 211 of the root portion 21 have the same center and the same pivotal pin, the outer arc-like edge 317 of the extending portion 312 is to automatically stay above the extending portion 211 of the root member 21 with some space between, keeping the left body 2 and the right body 3 engaged with each other merely by the engagement of the teeth 200 and the teeth 300, as shown in FIGS. 8, 9, 10 and 13. By the time, with the left body 2 and the right body 3 pushed outward to move in opposite direction by the compression spring 5, the teeth 200 and 300 are firmly engaged with each other to effectively clamp hair. When the bobby pin is to be released from hair, a user needs only to press the opening device (shown in FIG. 12) to move the extending portion 211 of the root member 21 to the bottom of the outer arc-like edge 317 of the extending portion 312 (shown in FIG. 13), so as to keep the teeth 200 of the left body 20 and the teeth 300 of the right body 30 disengaged from each other (shown in FIGS. 13 and 14), thus enabling the left body 2 and the right body 3 automatically snapped open by the torsion spring 4. Therefore, the bobby pin can be taken away from hair.

While the preferred embodiment of the invention has been described above, it will be recognized and understood that various modifications may be made therein and the appended claims are intended to cover all such modifications that may fall within the spirit and scope of the invention.

What is claimed is:

1. A bobby pin comprising:

a left body and a right body respectively provided with plural ribs that have plural teeth to correspond to each other, wherein for each of the left body and the right body, said teeth are arranged on free ends of the ribs and extend laterally; and an opening device installed in a root member provided in said left body and said right body respectively, said root member of said left body provided with two extending portions that are respectively bored with a through hole, said root member of said right body provided with plural extending portions, two of said extending portions of said right body respectively bored with a through hole, said opening device further comprising a torsion spring and a compression spring, one of said extending portions of said right body having a groove for fitting said torsion spring, another one of said extending portions of said right body having a groove for fitting said compression spring, a pivotal pin inserted through said torsion spring, said compression spring and said through holes of said extending portions of said left body and said right body, wherein when the bobby pin is in a closed position, the teeth on the left body and the teeth on the right body are engaged by directly contact with each other, thereby locking the ribs of the left body and the right body with each other and said torsion spring is configured in a manner such that when the teeth are disengaged, a force by said torsion spring separates the ribs of the left body from the ribs of the right body.

2. The bobby pin as claimed in claim 1, wherein one of said extending portions of said root portion of said left body is provided with an arc-like rim formed at its outer bottom.

3. The bobby pin as claimed in claim 1, wherein one of said extending portions of said root member of said right body is provided with an arc-like rim for stopping said extending portion of said root portion of said left body to restrict a maximum opening between said left body and said right body.

4. The bobby pin as claimed in claim 1, wherein an outer arc-like edge of another said extending portion of said right body is fitted inside one of said extending portions of said left body to contact each other to keep said left body and said right body from being pressed no more while said left and said right body are widely opened.

5. The bobby pin as claimed in claim 4, wherein said outer arc-like edge of said another of said extending portions of said right body is positioned above said one of said extending portions of said left body so that there is some space between said left and said right body to be pressed further while clamping hair.

6. The bobby pin as claimed in claim 1, wherein said groove of one of said extending portions of said right body is cut with a notch for fitting said torsion spring to make its two ends respectively lean on and push outward said left body and said right body.

7. The bobby pin as claimed in claim 1, wherein said teeth of said ribs of said left body and said right body are unidirectional ones.

8. A bobby pin comprising:

a left body and a right body respectively provided with ribs that have plural teeth to correspond to each other wherein for each of the left body and the right body, said teeth are arranged on free ends of the ribs and extend laterally; and an opening device installed in a root member provided in said left body and said right body respectively, said root member of said left body provided with plural extending portions, said root member of said right body provided with plural extending portions, one of said extending portions of said right body installed with a torsion spring, another of said extending portions of said right body installed with a compression spring, a pivotal pin inserted through said root member of said left body, said root portion of said right body, said torsion spring and said compression spring, said left body and said right body just being pressed inward to keep their teeth engaged and in direct contact with each other in case of clamping hair thereby locking the ribs of the left body and the right body with each other, said opening device being pressed in case of releasing said bobby pin from hair by disengaging said teeth, and said torsion spring is configured in a manner such that when the teeth are disengaged, a force by said torsion spring separates the ribs of the left body from the ribs of the right body.

9. A bobby pin comprising:

a left body and a right body, said left and said right body provided with a plurality of ribs respectively; and an opening device composed of a root member formed on said left and said right body, said root member of said left body having plural extensions, said root member of said right body having plural extensions, one of said extensions of said right body provided with a torque spring, another of said extensions of said right body provided with a compressive spring;

said left and said right body pressed inward with teeth formed in said left ribs and right ribs engaging and being in direct contact with each other in case of clamping hair thereby locking the ribs of the left body and the right body with each other, wherein for each of the left body and the right body, said teeth are arranged on free ends of the ribs and extend laterally, said opening device pressed to force said left and said right body open in case of releasing said bobby pin off hair by disengaging said teeth, wherein said teeth protrude in a direction parallel to a rotational axis of the left and right bodies, and said torque spring is configured in a manner such that when the teeth are disengaged, a force by said torque spring separates the ribs of the left body from the ribs of the right body.

10. The bobby pin as claimed in claim 9, wherein said ribs of said left and said right body are respectively provided with engaging teeth corresponding to one another.

11. The bobby pin as claimed in claim 9, wherein said left and said right body are provided with engaging teeth on corresponding walls.

* * * * *